US008654029B2

(12) United States Patent
Fan et al.

(10) Patent No.: US 8,654,029 B2
(45) Date of Patent: Feb. 18, 2014

(54) HOUSING OF PORTABLE ELECTRONIC DEVICE AND METHOD FOR MAKING THE SAME

(75) Inventors: Yong-Fa Fan, Shenzhen (CN); Yong Yan, Shenzhen (CN); Zhi-Guo Zhao, Shenzhen (CN); Zhao-Yi Wu, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 446 days.

(21) Appl. No.: 12/967,150

(22) Filed: Dec. 14, 2010

(65) Prior Publication Data

US 2011/0316759 A1 Dec. 29, 2011

(30) Foreign Application Priority Data

Jun. 28, 2010 (CN) ..... 2010 1 0210968

(51) Int. Cl.
*H01Q 1/40* (2006.01)

(52) U.S. Cl.
USPC ..... 343/873; 343/702; 29/600

(58) Field of Classification Search
USPC ..... 343/702, 873; 29/600
See application file for complete search history.

(56) References Cited

U.S. PATENT DOCUMENTS

| | | | | |
|---|---|---|---|---|
| 8,462,054 | B2 * | 6/2013 | Yang et al. | 343/702 |
| 2012/0268348 | A1 * | 10/2012 | Zhang et al. | 343/904 |
| 2013/0002493 | A1 * | 1/2013 | Jia et al. | 343/702 |
| 2013/0027252 | A1 * | 1/2013 | Lin | 343/700 MS |
| 2013/0062109 | A1 * | 3/2013 | Kimura et al. | 174/260 |
| 2013/0084405 | A1 * | 4/2013 | Lee et al. | 427/555 |
| 2013/0126465 | A1 * | 5/2013 | Hu et al. | 216/13 |
| 2013/0176179 | A1 * | 7/2013 | Park | 343/702 |

FOREIGN PATENT DOCUMENTS

| | | | |
|---|---|---|---|
| CN | 1518850 | A | 8/2004 |
| CN | 101500384 | A | 8/2009 |
| TW | I254552 | B | 5/2006 |
| TW | M373574 | U | 2/2010 |

* cited by examiner

*Primary Examiner* — Tan Ho
(74) *Attorney, Agent, or Firm* — Altis Law Group, Inc.

(57) ABSTRACT

A portable electronic device includes a base, an antenna radiator, an outer layer, and at least one conductive contact. The antenna radiator is formed on the activated base by plating. The antenna radiator is sandwiched between the base and the outer layer. One end of each conductive contact is electrically connected to the antenna radiator, and the other end of the each conductive contact is exposed.

14 Claims, 7 Drawing Sheets

HOUSING OF PORTABLE ELECTRONIC DEVICE AND METHOD FOR MAKING THE SAME

This application is one of the three related co-pending U.S. patent applications listed below. All listed applications have the same assignee and were concurrently filed herewith. The disclosure of each of the listed applications is incorporated by reference into all the other listed applications.

| Title | Inventors |
|---|---|
| HOUSING OF PORTABLE ELECTRONIC DEVICE AND METHOD FOR THE MAKING SAME | Fan et al. |
| HOUSING OF PORTABLE ELECTRONIC DEVICE AND METHOD FOR MAKING THE SAME | Wu et al. |
| HOUSING OF PORTABLE ELECTRONIC DEVICE AND METHOD FOR MAKING THE SAME | Wu et al. |

BACKGROUND

1. Technical Field

The present disclosure relates to housings of portable electronic devices, especially to a housing having a three-dimensional antenna formed thereon and a method for making the housing.

2. Description of Related Art

Portable electronic devices, such as mobile phones, personal digital assistants (PDAs) and laptop computers are widely used. Most of these portable electronic devices have antenna modules for receiving and sending wireless signals. A typical antenna includes a thin metal radiator element mounted to a support member, and attached to a housing. However, the radiator element is usually exposed from the housing, and may be easily damaged. In addition, the radiator element and the support member occupy precious space. To solve this problem, a conductive ink is formed on the housing to form the antenna by a screen-printing method. However, this method is usually used to manufacture two-dimensional antennas, and the function of the antenna is limited.

Therefore, there is room for improvement within the art.

BRIEF DESCRIPTION OF THE DRAWINGS

Many aspects of the exemplary embodiment of a portable electronic device can be better understood with reference to the following drawings. The components in the drawings are not necessarily drawn to scale, the emphasis instead being placed upon clearly illustrating the principles of the portable electronic device. Moreover, in the drawings, like reference numerals designate corresponding parts throughout the several views, in which.

DETAILED DESCRIPTION

The disclosure is illustrated by way of example and not by way of limitation in the accompanying drawings. It should be noted that references to "an" or "one" embodiment in this disclosure are not necessarily to the same embodiment, and such references can include the meaning of "at least one" embodiment where the context permits.

Figure 1:
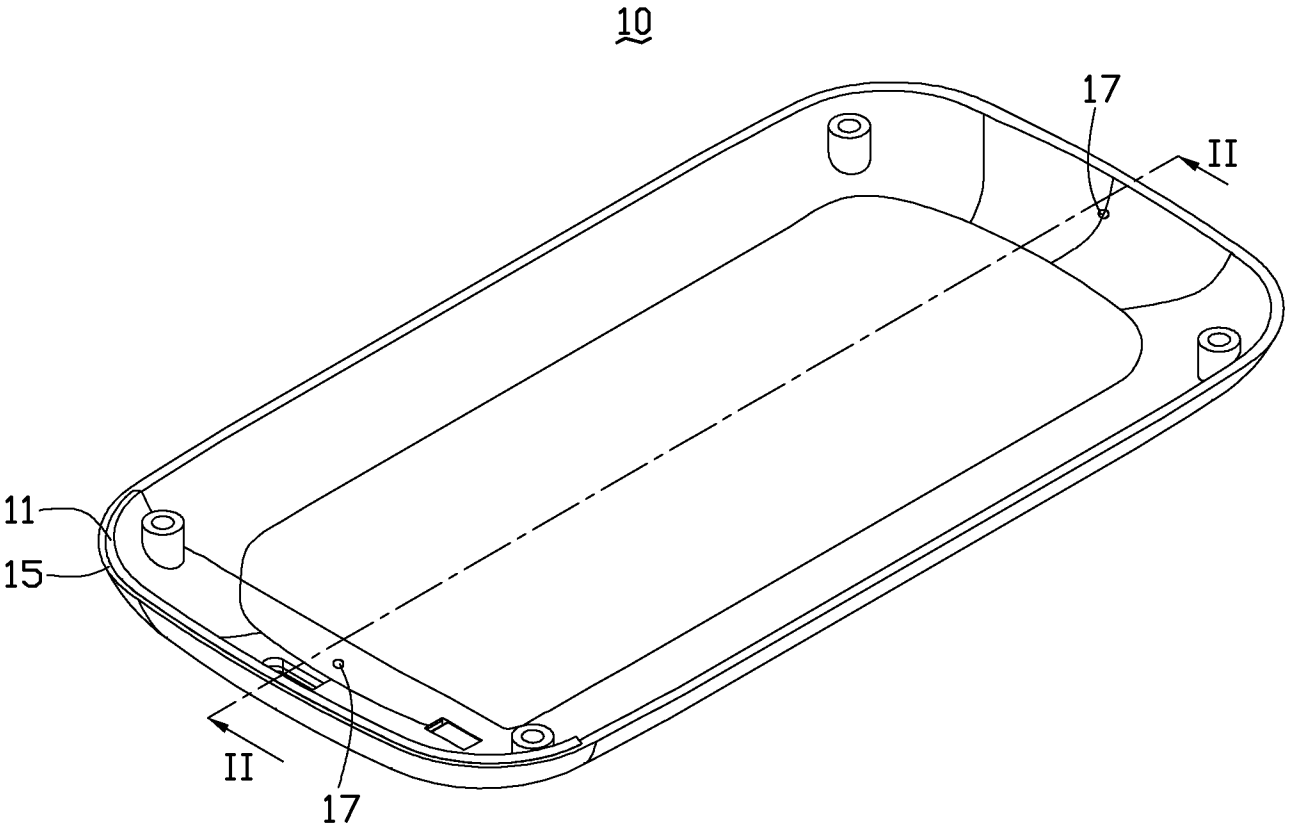
FIG. 1 is a schematic view of a housing of a first exemplary embodiment.

FIG. 1 shows a first embodiment of a housing 10 for an electronic device where an antenna is desired, such as a mobile phone, a PDA, and so on. The housing includes a base 11, an antenna radiator 13, an outer layer 15, and a number of conductive contacts 17. The antenna radiator 13 is a three dimensional antenna and is sandwiched between the base 11 and the outer layer 15. The conductive contacts 17 are embedded in the housing 10 by insert-molding. One end of each conductive contact 17 is electrically connected to the antenna radiator 13, and the other end is exposed from the base 11 so that the electronic device can receive or transmit signals through the antenna radiator 13.

Figure 2:
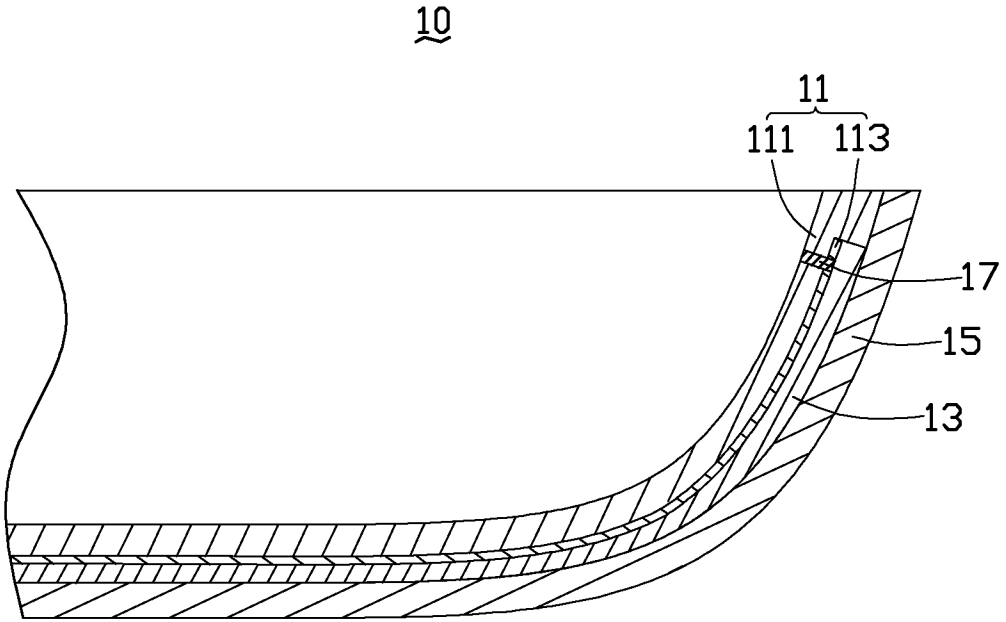
FIG. 2 is a cross-sectional view of a portion of the housing taken along line II-II of FIG. 1.

Referring to FIG. 2, the base 11 includes a first injection layer 111 and a second injection layer 113 formed on the injection layer 111. The first injection layer 111 may be made of moldable plastic. The moldable plastic may be one or more thermoplastic materials selected from a group consisting of polypropylene (PP), polyamide (PA), polycarbonate (PC), polyethylene terephthalate (PET), and polymethyl methacrylate (PMMA). The thickness of the injection layer 111 can be one third to three fifths of the thickness of the housing 10.

The second injection layer 113 can be a mixture of materials selected from a group consisting of thermoplastic, organic filling substances, and laser activator. The thermoplastic can be made of polybutylene terephthalate (PBT) or polyesterimide (PI). The organic filling substances can be made of silicic acid and/or silicic acid derivatives. The laser activator can be made of non-conductive spinel-based inorganic oxide, such as spinel type copper. The mixture includes: the thermoplastic –65% to 75% by weight, the organic filling substances –22% to 28% by weight, and the non-conductive oxide –3% to 7% by weight. The non-conductive oxide can be activated by laser to precipitate metallic crystal nucleus covering at least part of the surface distal from the first injection layer 11 of the second injection layer 113.

The antenna radiator 13 can be formed by plating on the laser activated second injection layer 113. A number of layers may be plated, including a copper layer, a nickel layer, and a gold layer, which are stacked on the second injection layer 113 in series. The copper layer acts as the radiator of the antenna radiator 13. The nickel layer connects the copper layer with the gold layer to prevent the gold layer from ablating. The gold layer is highly conductive for enhancing stability of the antenna radiator 13 and preventing the antenna from being oxidized.

The outer layer 15 may be made of moldable plastic. The moldable plastic may be one or more thermoplastic materials selected from a group consisting of PP, PA, PC, PET, and PMMA.

Figure 3:
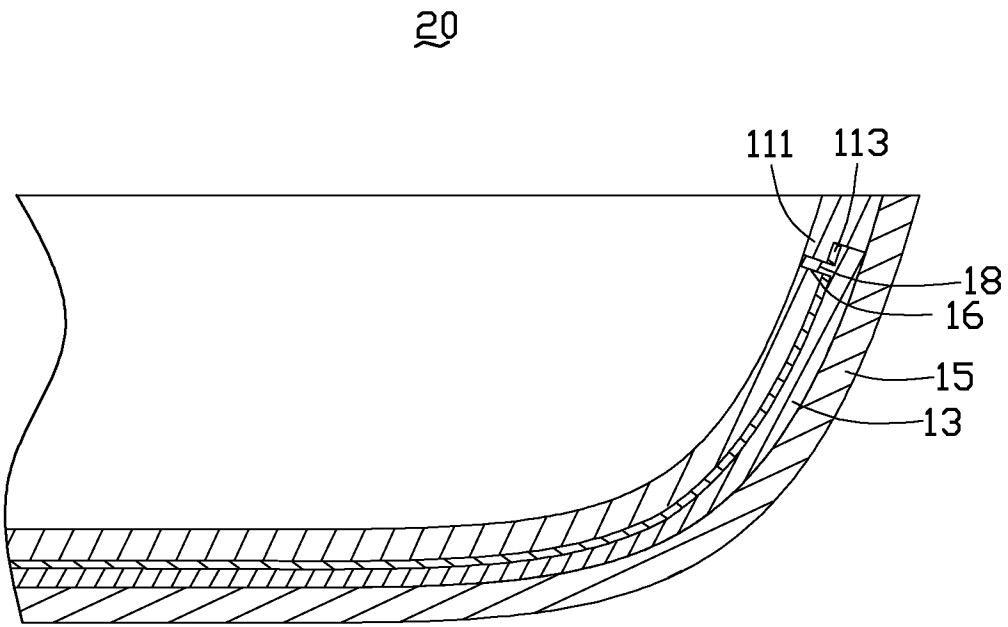
FIG. 3 is a cross-sectional view of a portion of a housing of a second embodiment.

Referring to FIG. 3, in the second embodiment, a housing 20 is similar to the housing 10 of the first embodiment, however, when the first and second injection layers 111 and 113 are injected, a number of through holes 16 are reserved, and the through holes 16 are filled with metal to form conductive contacts 18 during plating.

Figure 4:
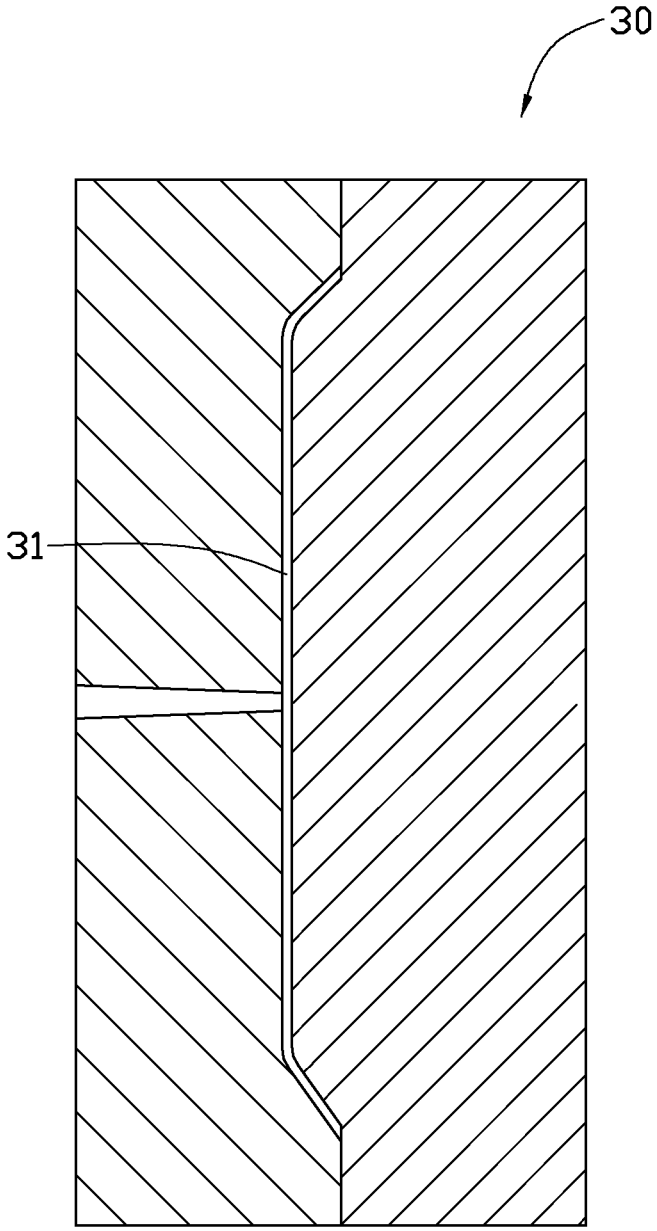
FIG. 4 is a cross-sectional view of a portion of a first molding machine for making the housing of FIG. 1.
Figure 7:
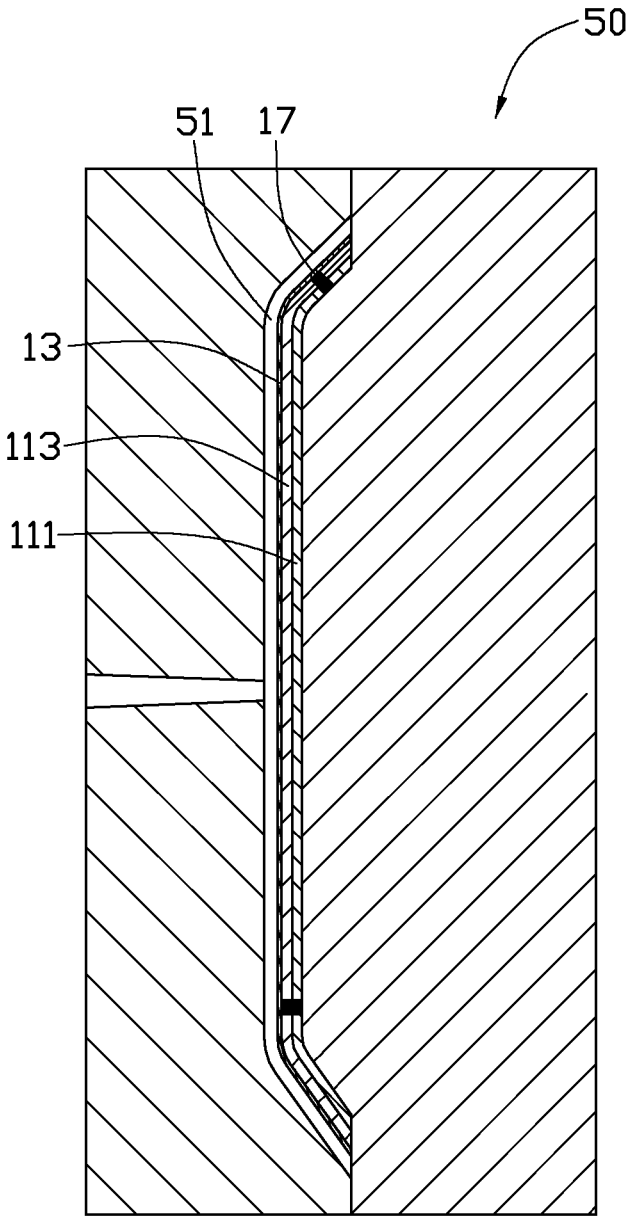
FIG. 7 is a view of a portion of a second injection molding machine for making the housing of FIG. 1.

A first exemplary method for making the housing 10 of the first embodiment may include the following steps:

Referring to FIGS. 4 and 7, a first injection molding machine 30 and a second injection molding machine 50 are provided. The first injection molding machine 30 is a double-shot molding machine and includes a first molding chamber 31. The second injection molding machine 50 includes a second molding chamber 51.

Figure 5:
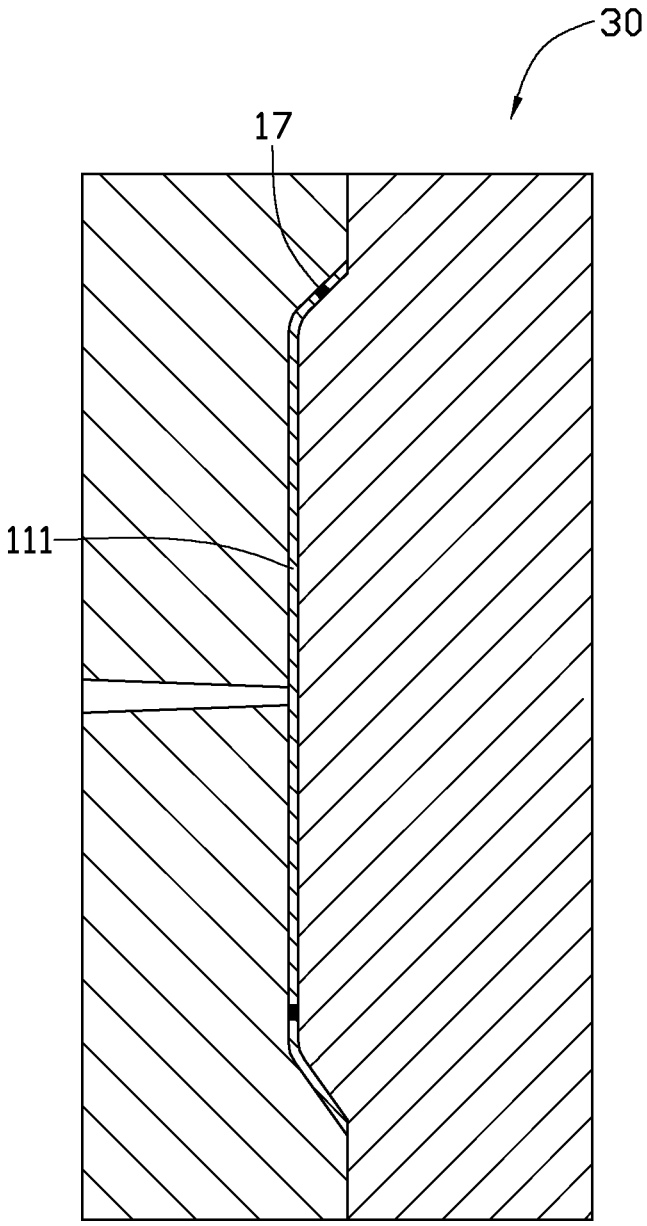
FIG. 5 is similar to FIG. 4, but showing a first injection layer formed.

Referring to FIG. 5, the conductive contacts 17 are placed in the first injection molding machine 30, and the thermoplastic material is injected into the first molding chamber 31 to form the first injection layer 111. The moldable plastic may be one or more thermoplastic materials selected from a group consisting of PP, PA, PC, PET, and PMMA. The thickness of the injection layer 111 can be one third to three fifths of the thickness of the housing 10.

Figure 6:
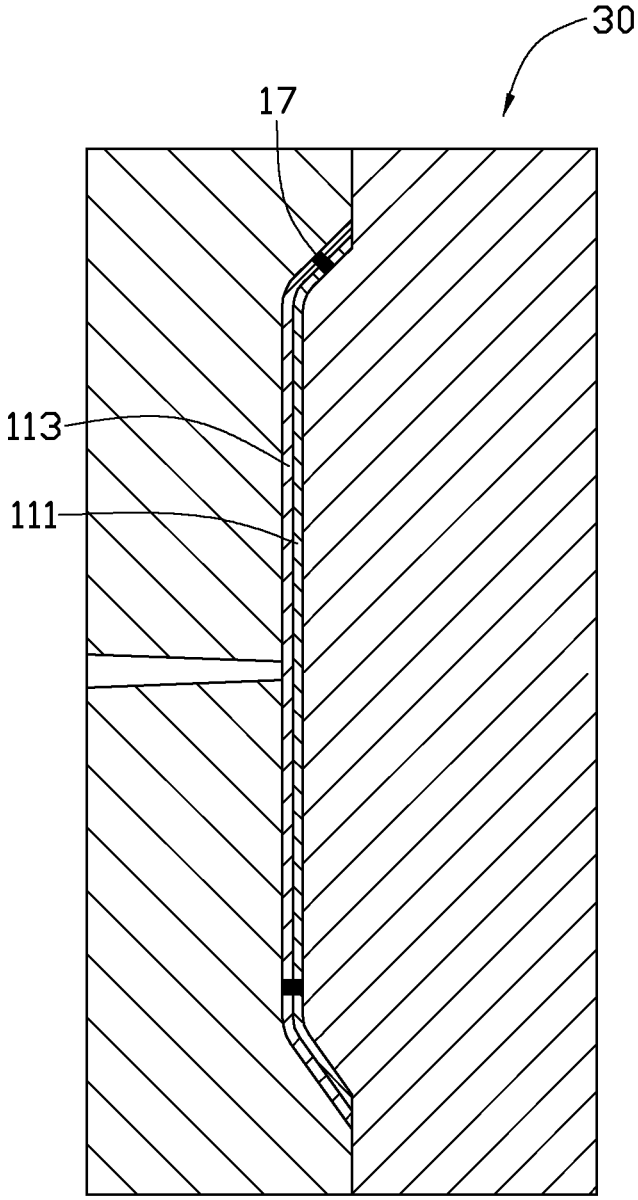
FIG. 6 is similar to FIG. 5, but showing a second injection layer formed.

Referring to FIG. 6, the mixture of materials selected from a group consisting of thermoplastic, organic filling substances, and laser activator, is injected into the first molding chamber 31 to form a second injection layer 113 on top of the first injection layer 111 so that the base 11 is provided. The thermoplastic can be made of PBT or PI. The organic filling substances can be made of silicic acid and/or silicic acid derivatives. The laser activator can be made of non-conductive spinel-based inorganic oxide, such as spinel type copper. The mixture includes: the thermoplastic –65% to 75% by weight, the organic filling substances –22% to 28% by weight, and the non-conductive oxide –3% to 7% by weight.

The non-conductive oxide is activated by laser direct structuring (LDS) to precipitate metallic crystal nucleus covering the surface distant from the first injection layer 111 of the second injection layer 113 so that a metal area is provided on the second injection layer 113.

The metal area is metalized to form the antenna radiator 13 by using a metallization process. The metallization process can be an electro-plating or a chemical plating method to form the plating layer. The metal area is conductive, thus it can be plated with layers including a copper layer, a nickel layer, and a gold layer in that order.

Referring to FIG. 7, the base 11 combing the antenna radiator 13 is placed in the second injection molding chamber 51 of the second injection molding machine 50, the thermoplastic plastic is injected into the second molding chamber 51 to form the outer layer 15. Then, the outer layer 15 is attached to one side of the base 11 and buries the three-dimensional antenna 13.

A second method for making the housing 10 may include the following steps.

The thermoplastic material is injected into the first molding chamber 31 to form the outer layer 15. The moldable plastic may be one or more thermoplastic materials selected from a group consisting of PP, PA, PC, PET, and PMMA.

Referring to FIG. 7, the base 11 with the antenna radiator 13 is placed into the second chamber 51 of the second injection machine 50. Then, the thermoplastic is injected into the second molding chamber 51 to bury the antenna radiator 13 and be integrated with the base 11. Thus, the housing 10 is provided.

An exemplary process of making the housing 20 of the second embodiment is similar to the process described above, however, when the first and second injection layers 111 and 113 are injected, a number of through holes 16 are reserved, and the through holes 16 are filled with metal during plating.

The antenna radiator 13 is sandwiched between the base 11 and the outer layer 15 so that the antenna radiator 13 is protected from being damaged. In addition, the antenna radiator 13 can be directly attached to the housing 10, thus, the working efficiency is increased.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A method for making a housing, comprising:

providing a first injection molding, machine defining a first molding chamber and a second injection molding, machine defining a second molding chamber;

placing at least one conductive contact into the first molding chamber, and thermoplastic material injected into the first molding chamber to form a first injection layer;

injecting a mixture material into the first molding chamber to form a second injection layer the mixture materials selected from a group consisting of thermoplastic, organic filling substances, and laser activator;

activating the second injection layer by laser direct structuring to precipitate metallic crystal nucleus covering at least part of the second injection layer;

metalizing the activated second injection layer to form an antenna radiator;

placing the first and second injection layers combing the antenna radiator into the second molding chamber, thermoplastic material injected into the second molding chamber to form an outer layer, the antenna radiator sandwiched between the outer layer and the second injection layer.

2. The method for making a housing as claimed in claim 1, wherein the thermoplastic is made of polybutylene terephthalate or polyesterimide, the organic filling substances are made of silicic acid and/or silicie acid derivatives, and the laser activator is of non-conductive spinel-based inorganic oxide.

3. The method for making a housing as claimed in claim 2, wherein the laser activator is of spinel type copper.

4. The method for making a housing as claimed, in claim 2, wherein the mixture includes the thermoplastic 65% to 75% by weight, the organic filling substances 22% to 28% by weight, the non-conductive oxide 3% to 7% by weight.

5. The method for making a housing as claimed in claim 1, wherein the first injection layer is made of moldable plastic, the moldable plastic is one or more thermoplastic materials selected from a group consisting of polypropylene, polyamide, polycarbonate, polyethylene terephthalate, and polymethyl methacrylate.

6. The method for making a housing as claimed in claim 1, wherein the antenna comprises a copper layer, a nickel layer, and a gold layer, the copper layer, the nickel layer and the gold layer are stacked on the second injection layer in series.

7. A method for making a housing, comprising:

providing a first injection molding machine defining a first molding chamber and a second injection molding machine defining a second molding chamber;

injecting thermoplastic material into the first molding chamber to form a first injection layer, and injecting a mixture of materials selected from a group consisting of thermoplastic, organic filling substances, and laser activator, into the first molding chamber to form a second injection layer, the first and second injection layers forming a base, at least one through hole reserved in the base during injecting;

activating the second injection layer by laser direct structuring to precipitate metallic crystal nucleus covering at least part of the second injection layer;

metalizing the activated second injection layer to form an antenna radiator;

placing, the first and second injection layers combing the antenna radiator into the second molding chamber, and injecting thermoplastic material into the second molding chamber to form an outer layer, the antenna radiator buried by both the outer layer and the base.

8. The method for making a housing as claimed in claim 7, wherein the thermoplastic is made of polybutylene terephthalate or polyesterimide, the organic filling, substances are made of silicic acid and/or silicic acid derivatives, and the laser activator is of non-conductive spinel-based inorganic oxide.

9. The method for making a housing as claimed in claim 8, wherein the laser activator is of spinel type copper.

10. The method for making as housing as claimed in claim 8, wherein the mixture includes the thermoplastic 65% to 75% by weight, the organic filling substances 22% to 28% by weight, the non-conductive oxide 3% to 7% by weight.

11. The method for making, a housing as claimed, in claim 7, wherein the first injection layer is made of moldable plastic, the moldable plastic is one or more thermoplastic materials selected from a group consisting of polypropylene, polyamide, polycarbonate, polyethylene terephthalate, and polymethyl methacrylate.

12. The method for making a housing as claimed in claim 7, wherein the antenna comprises a copper layer, a nickel layer, and a gold layer, the copper layer, the nickel layer and the gold layer are stacked on the second injection layer in series.

13. The method for making a housing as claimed in claim 7, wherein the inner wall of each of the at least one through hole metalized to be conductive during plating.

14. The method for making a housing as claimed in claim 7, wherein the at least one through hole is tilled with metal during plating.

* * * * *